US006798316B2

(12) United States Patent
Ono et al.

(10) Patent No.: US 6,798,316 B2
(45) Date of Patent: Sep. 28, 2004

(54) DIELECTRIC DUPLEXER

(75) Inventors: Shoji Ono, Ise (JP); Hidefumi Suzuki, Ise (JP); Yukihiro Hamaguchi, Mie (JP)

(73) Assignee: NGK Spark Plug.Co., Ltd., Nagoya (JP)

( * ) Notice: Subject to any disclaimer, the term of this patent is extended or adjusted under 35 U.S.C. 154(b) by 0 days.

(21) Appl. No.: 10/235,657

(22) Filed: Sep. 6, 2002

(65) Prior Publication Data

US 2003/0042996 A1 Mar. 6, 2003

(30) Foreign Application Priority Data

Sep. 6, 2001 (JP) ..... 2001-270616

(51) Int. Cl.[7] ..... H01P 5/12
(52) U.S. Cl. ..... 333/134; 333/202; 333/206
(58) Field of Search ..... 333/206, 134, 333/202

(56) References Cited

U.S. PATENT DOCUMENTS 4,879,533 A * 11/1989 de Muro et al. ..... 333/206
5,818,311 A * 10/1998 Hino ..... 333/202
5,864,264 A * 1/1999 Hino ..... 333/206
5,905,420 A * 5/1999 Tsujiguchi et al. ..... 333/206
6,023,207 A * 2/2000 Ito et al. ..... 333/206
6,281,768 B1 * 8/2001 Tada et al. ..... 333/206
6,507,250 B1 * 1/2003 Tada et al. ..... 333/134
6,549,101 B2 * 4/2003 Gotoh et al. ..... 333/202
6,597,263 B2 * 7/2003 Jun et al. ..... 333/202

FOREIGN PATENT DOCUMENTS

JP 59-4402 1/1984
JP 62-109503 7/1987

* cited by examiner

*Primary Examiner*—Robert Pascal
*Assistant Examiner*—Kimberly Glenn
(74) *Attorney, Agent, or Firm*—Stites & Harbison, PLLC; Ross F. Hunt, Jr.

(57) ABSTRACT

A dielectric duplexer device is provided with an output terminal pad formed on a side surface of a dielectric block in the vicinity of an open end associated with a plurality of resonators of a reception section in such a manner as to face the resonators. An extension electrode extends from the output terminal pad onto an end face of the dielectric block where the open end is present, to thereby be capacitively coupled with the resonators. The coupling capacitance can be readily corrected by adjusting the position of the end of the extension electrode. In one specific form, when the dielectric duplexer is mounted, the extension electrode is exposed and is also joined to a predetermined conductive path by means of solder. Accordingly, the output terminal pad is soldered at the bottom and side surfaces thereof to thereby be fillet-soldered, thereby providing visibility of electrical and mechanical connections thereof to the predetermined conductive path and thus enhancing the reliability of the mounted state.

10 Claims, 4 Drawing Sheets

DIELECTRIC DUPLEXER

FIELD OF THE INVENTION

The present invention relates to a dielectric duplexer having a plurality of resonators arranged in a row for use in mobile communication devices such as car phones and cellular phones.

BACKGROUND OF THE INVENTION

Various prior art dielectric duplexer devices are configured in the form of a plurality of resonators arranged in a row in a dielectric ceramic porcelain block material such as porcelain. Each of the resonators is formed by coating the internal circumferential surface of a through-hole formed in the dielectric porcelain block with an internal conductor. A predetermined external circumferential surface of the dielectric porcelain block is coated with an external conductor. The resonators comprise two groups. One group serves as a transmission section, which is coupled with an input terminal pad formed on the predetermined external circumferential surface, separated from the external conductor. The other group serves as a reception section, which is coupled with an output terminal pad formed on the predetermined external circumferential surface, separated from the external conductor. An antenna terminal pad is formed on a mounting surface of the dielectric duplexer, separated from the external conductor in such a manner as to be coupled with the respective resonators of the transmission section and of the reception section located closest to one another in the row.

A further prior art dielectric duplexer device is configured as above but also includes an output terminal pad formed on a side surface of the dielectric porcelain block in order to face the resonators of the reception section in the vicinity of their open ends, whereby the output terminal pad is capacitively coupled with the resonators.

The above-mentioned dielectric duplexer device, i.e., the device with the output terminal pad formed on the side surface of the dielectric porcelain block while being capacitively coupled with the resonators of the reception section, involves the following problem. The dielectric duplexer is mounted on a printed circuit board such that the output terminal pad is electrically joined to a predetermined conductive path on the board through soldering. Since the state of a joint between the conductive path and the output terminal pad cannot be visually observed from the outside, the joint involves uncertainty as to electrical and mechanical connection and thus always falls under suspicion when a defect arises at a later stage. Further, since the connected state is invisible, the retention strength cannot be reliably known. Therefore, a dielectric duplexer of conventional configuration fails to provide sufficient electrical and mechanical reliability in a mounted state.

SUMMARY OF THE INVENTION

The present invention concerns a dielectric duplexer which has improved electrical and mechanical reliability in a mounted state and which facilitates adjustment of the coupling capacitance provided.

The present invention concerns a dielectric duplexer configured such that a plurality of resonators are arranged in a row in a dielectric material such as porcelain block. Each of the resonators are formed through coating an internal circumferential surface of a through-hole formed in the dielectric block with an internal conductor. A predetermined external circumferential surface of the dielectric porcelain block is coated with an external conductor. The resonators are divided into two groups. One group serves as a transmission section, which is coupled with an input terminal pad formed on the predetermined external circumferential surface, separated from the external conductor. The other group serves as a reception section, which is coupled with an output terminal pad formed on the predetermined external circumferential surface, separated from the external conductor. An antenna terminal pad is formed on a mounting surface of the dielectric duplexer separated from the external conductor in such a manner as to be coupled with the innermost resonator of the transmission section and the innermost resonator of the reception section.

In accordance with an important feature of the invention, the dielectric duplexer includes the output terminal pad formed on a side surface of the dielectric block and separated from the external conductor in such a manner as to face the vicinity of an open end of a resonator of the reception section. In addition, an extension electrode extends from the output terminal pad onto an end face of the dielectric block such that the extension electrode approaches the open end in order to capacitively couple with the resonator.

Since the extension electrode extending from the output terminal pad and located on the open end face is disposed to face the resonators of the reception section, a capacitance is provided between the extension electrode and the internal conductor of the resonator. This capacitance can be readily corrected or adjusted by adjusting the position of the end of the extension electrode. The end position is adjusted by, for example, cutting off a portion of the end or adding a conductor to the end.

When the dielectric duplexer is mounted on a printed circuit board such that the output terminal pad is electrically joined to a predetermined conductive path on the board through soldering, the extension electrode located on an exposed surface of the dielectric duplexer can be soldered to the predetermined conductive path from the outside. Thus, the output terminal pad is soldered at the bottom and side surfaces thereof, i.e., the output terminal pad is fillet-soldered. Therefore, the connection between the output terminal pad and the predetermined conductive path can be checked externally. Further, since the extension electrode is connected to the predetermined conductive path, the surface of joint is expanded, thereby enhancing the retention strength thereof.

Further features and advantages of the present invention will be set forth in, or apparent from, the detailed description of preferred embodiments thereof which follows.

DESCRIPTION OF THE PREFERRED EMBODIMENTS

An embodiment of the present invention will now be described with reference to the accompanying drawings.

Figure 1:
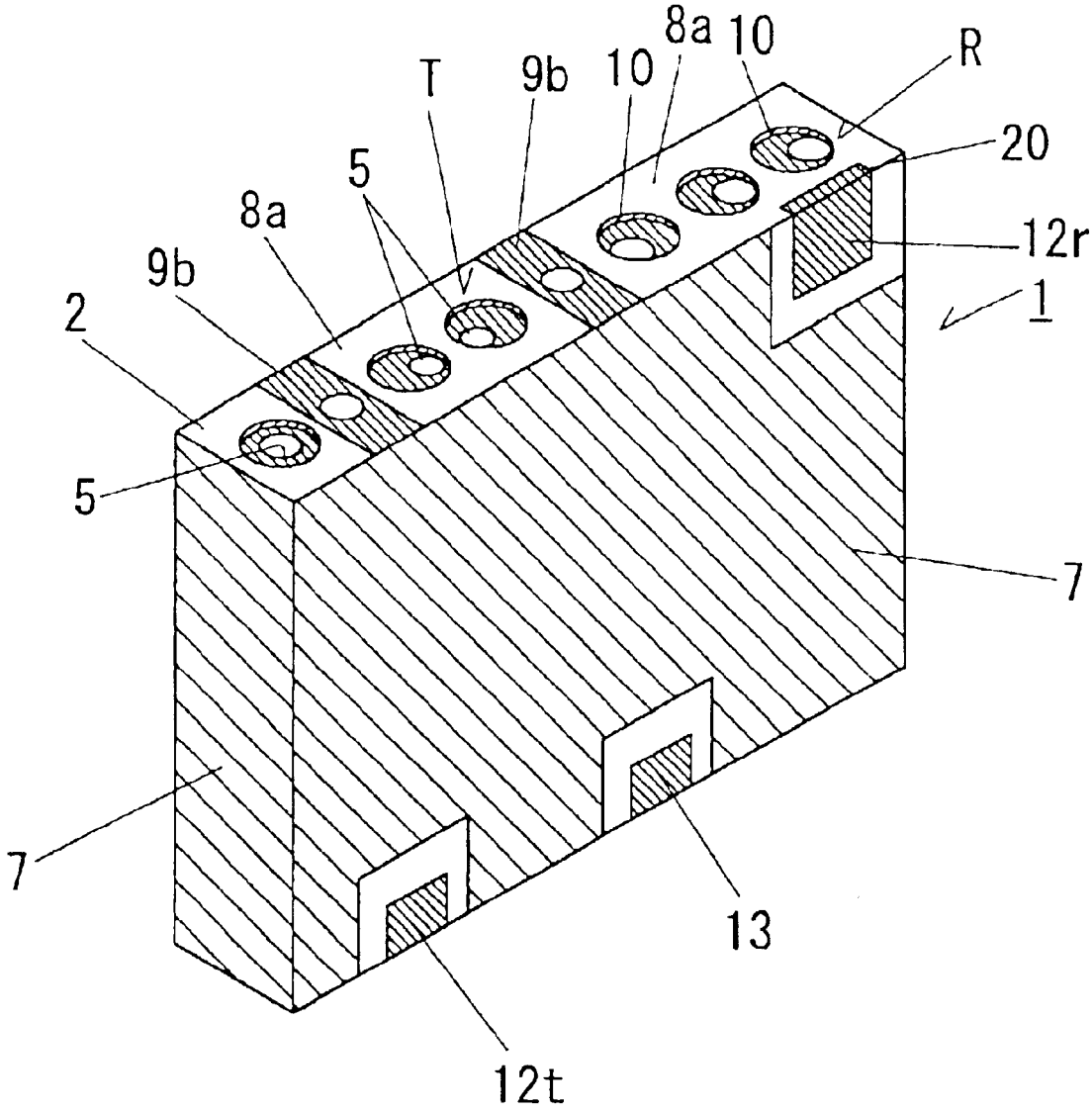
FIG. 1 is a perspective view of a dielectric duplexer according to an embodiment of the present invention.
Figure 2:
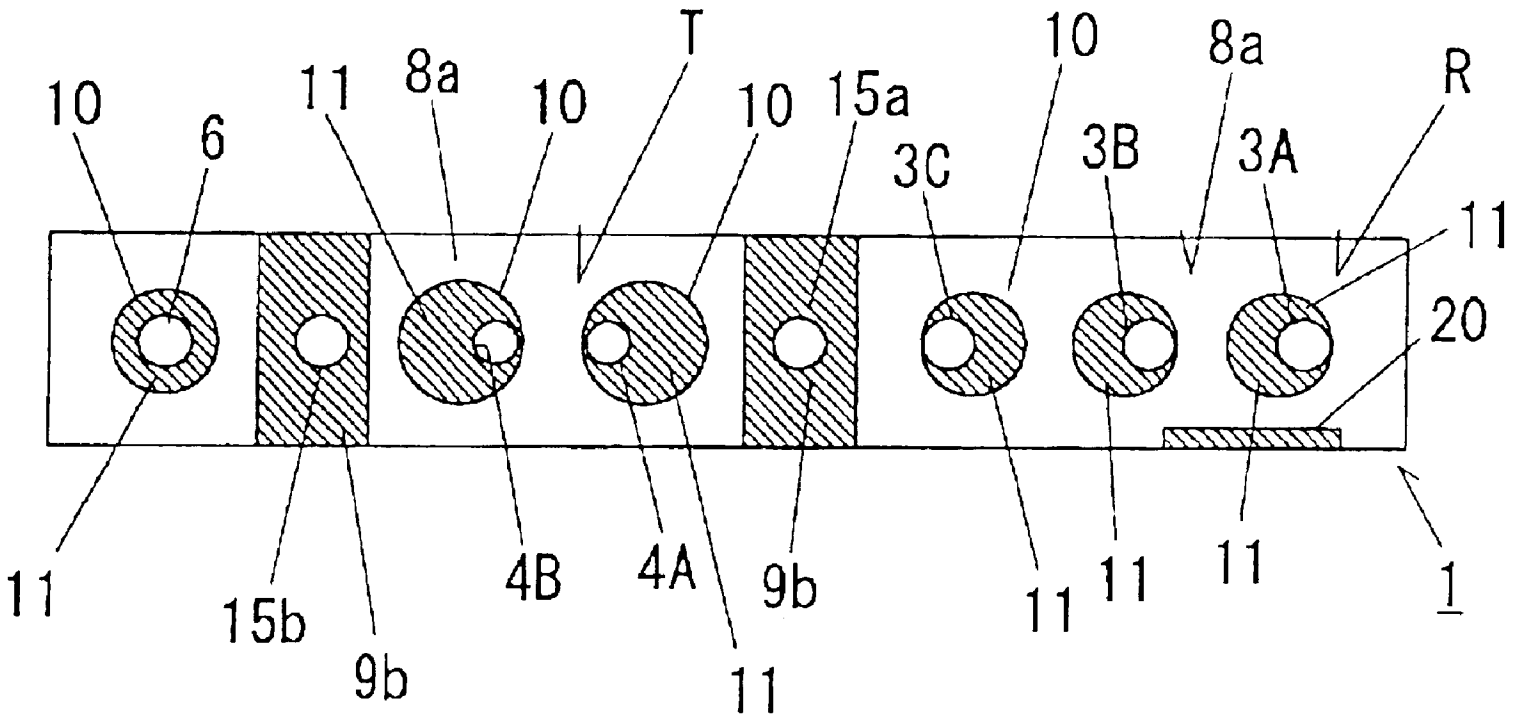
FIG. 2 is a top plan view of the dielectric duplexer of FIG. 1.
Figure 3:
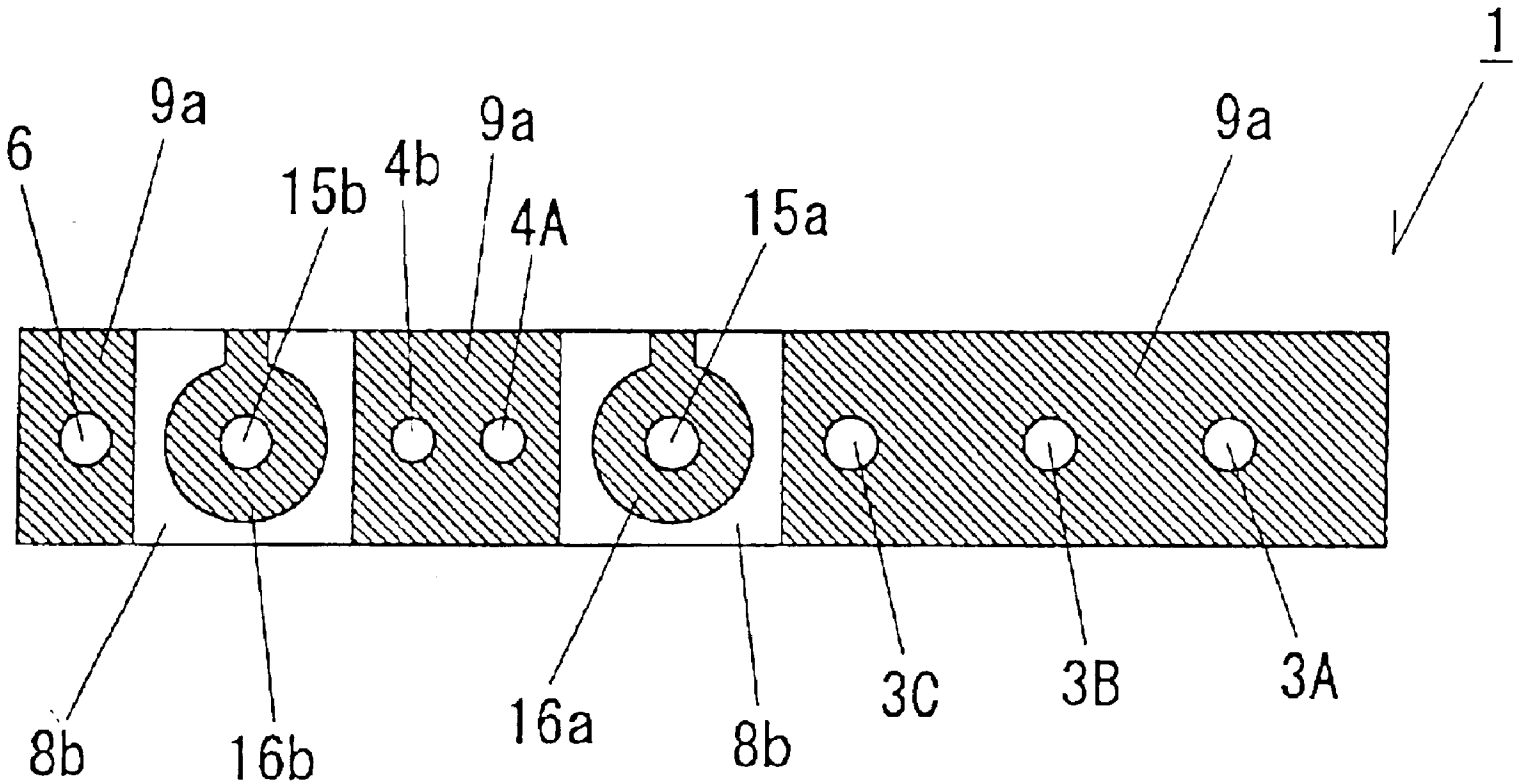
FIG. 3 is a bottom plan view of the dielectric duplexer of FIG. 1.
Figure 4:
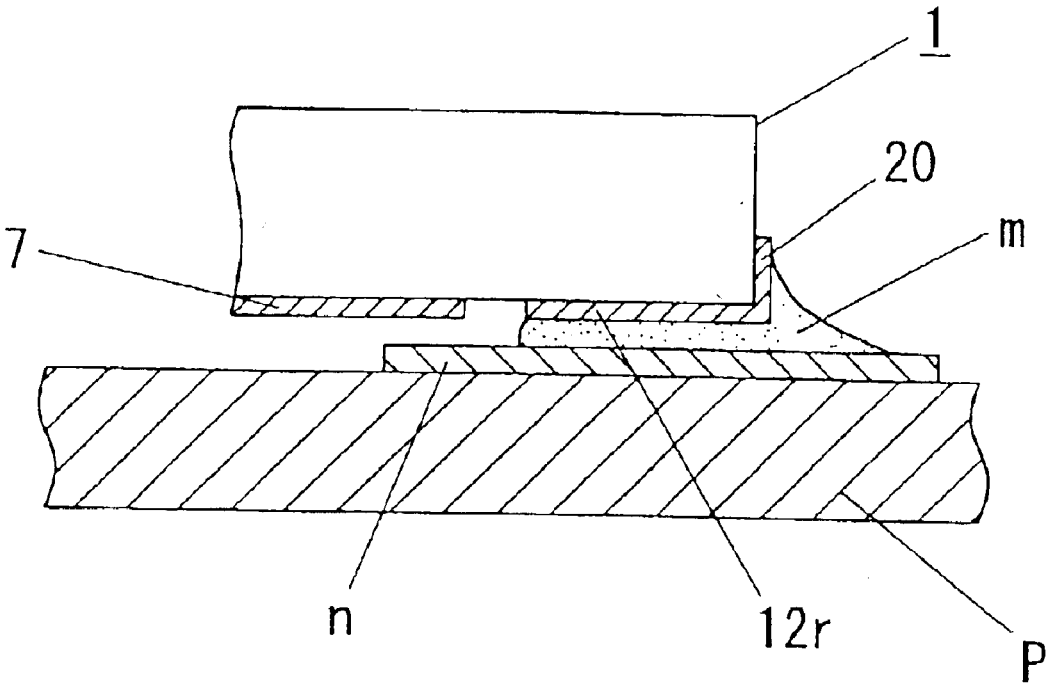
FIG. 4 is a sectional fragmentary view showing the mounted dielectric duplexer of FIG. 1.

FIGS. 1 to 3 show a dielectric duplexer 1 in which eight through-holes 5 each coated with an internal conductor are formed in a dielectric ceramic block 2 of, for example, porcelain and having a flat, rectangular parallelepiped shape. Referring to FIG. 2, the through-holes 5 are described from the right: the three rightmost through-holes 5 serve as reception resonators 3A–3C; the fourth through-hole 5 serves as an antenna excitation hole 15*a*; the subsequent two through-holes 5 serve as transmission resonators 4A and 4B; the seventh through-hole 5 serves as a transmission excitation hole 15*b*; and the leftmost through-hole 5 serves as a trap formation resonator 6. The through-holes 5 are grouped in this manner, whereby the dielectric duplexer 1 is configured such that a group consisting of the three resonators 3A, 3B, and 3C serves as a three-pole-type reception section R, whereas a group consisting of the two resonators 4A and 4B serves as a two-pole-type transmission section T. The resonators 3A–3C, 4A, 4B, and 6 substantially assume a length corresponding to $\lambda/4$, where $\lambda$ is a wavelength corresponding to the predetermined resonant frequency. The dielectric porcelain block 2 is coated with an external conductor 7 on a predetermined outer circumferential surface thereof. The external conductor 7 serves as a shield electrode.

The resonators 3A–3C, 4A, 4B, and 6 are arranged in a row in the dielectric porcelain block 2. A portion of one end face of the dielectric porcelain block 2 serves as an open end 8*a*, where the external conductor 7 is absent, associated with the resonators, whereas a portion of the opposite end face of the dielectric porcelain block 2 serves as a short circuit end 9*a* associated with the resonators.

The antenna excitation hole 15*a* and the transmission excitation hole 15*b* assume an interdigital structure in relation to the resonators. Specifically, an open end 8*b* and a short circuit end 9*b* associated with the excitation holes 15*a* and 15*b* are located opposite the open end 8*a* and the short circuit end 9*a* associated with the resonators.

Annular counterbores 10 for coupling adjacent resonators are formed on the open end 8*a* associated with the resonators 3A–3C, 4A, 4B, and 6 around the corresponding openings. An extension conductor 11 is formed on the bottom surface of each of the counterbores 10 and is connected to the corresponding internal conductor. An interval between the counterbores 10 is defined as an interval between resonators. A coupling capacitance of the resonators can be determined by means of the position, size, and shape of the counterbores 10.

An antenna terminal pad 13 is formed, separated from the external conductor 7, on a side surface of the dielectric porcelain block 2 in the vicinity of the open end 8*b* associated with the antenna excitation hole 15*a*, and is connected to the excitation hole 15*a* via a connection conductor 16*a*. In this manner, the antenna terminal pad 13 is coupled via the excitation hole 15*a* with the respective resonators 3C and 4A of the reception section R and the transmission section T located closest to one another in the row.

Similarly, an input terminal pad 12*t* is formed, separated from the external conductor 7, on a side surface of the dielectric porcelain block 2 in the vicinity of the open end 8*b* associated with the transmission excitation hole 15*b*, and is connected to the excitation hole 15*b* via a connection conductor 16*b*. In this manner, the input terminal pad 12*t* is coupled with the transmission section T via the excitation hole 15*b*.

The output terminal pad 12*r* of the reception section R is formed on the mounting surface of the dielectric duplexer 1 separated from the external conductor 7 while the greatest possible distance is established from the above-described antenna terminal pad 13. Specifically, the output terminal pad 12*r* is formed separated from the external conductor 7 in the vicinity of the open end 8*a*, which is located on the side opposite the open end 8*b*, while facing the resonators 3A and 3B located at the endmost position of the reception section R. In this manner, the output terminal pad 12*r* is capacitively coupled with the reception section R.

In the embodiment shown in FIG. 2, an extension electrode 20 is extended from the output terminal pad 12*r* onto an end face of the dielectric porcelain block 2 where the open end 8*a* is located, to thereby be capacitively coupled with the resonators 3A and 3B. Formation of the extension electrode 20 in opposition to the resonators 3A and 3B of the reception section R generates capacitance between the extension electrode 20 and the internal electrodes of the resonators 3A and 3B. This capacitance can be readily corrected by adjusting the position of the end of the extension electrode 20. Specifically, when the capacitance is excessive, the end is cut off or otherwise reduced in size. When the capacitance is insufficient, a conductor is added to the end. Since the extension electrode 20 is exposed, this adjustment can be performed even after the dielectric duplexer 1 is mounted on a printed circuit board p, thereby facilitating matching with peripheral devices.

The dielectric duplexer 1 is mounted on the printed circuit board p such that the input terminal pad 12*t*, the output terminal pad 12*r*, and the antenna terminal 13 are electrically and mechanically soldered to corresponding predetermined conductive paths n on a circuit of the printed circuit board p by means of a solder m. In this case, the input terminal pad 12*t* is connected to the transmission excitation hole 15*b* via the connection conductor 16*b*, and the antenna terminal 13 is connected to the antenna excitation hole 15*a* via the connection conductor 16*a*. Thus, when the dielectric duplexer 1 is mounted on the printed circuit board p, the connection inductors 16*a* and 16*b*—which are located on an end face of the dielectric porcelain block 2 where the corresponding open ends 8*b* associated with the excitation holes 15*a* and 15*b* are present—are exposed, and the rectangular ends of the connection conductors 16*a* and 16*b* are also soldered to the corresponding predetermined conductive paths n by means of the solder m. Thus, the input terminal pad 12*t* and the antenna terminal 13 are soldered at the bottom and side surfaces thereof via the connection conductors 16*b* and 16*a*, respectively, i.e., each of the input terminal pad 12*t* and the antenna terminal 13 is fillet-soldered, thereby ensuring electrical and mechanical connections thereof and enabling visibility of the state of connection thereof from the outside.

As described above, the extension electrode 20 extending from the output terminal pad 12*r* is located on an end face of the dielectric porcelain block 2 while facing the resonators 3A and 3B of the reception section R. Therefore, when the dielectric duplexer 1 is mounted on the printed circuit board p, the extension electrode 20—which is located on the end face of the block 2 where the open end 8*a* associated with the resonators 3A and 3B is present—is exposed. Thus, the exposed extension electrode 20 is also soldered to a predetermined conductive path n by means of the solder m. Accordingly, the output terminal pad 12*r* is soldered at the bottom and side surfaces thereof; i.e., the output terminal pad 12*r* is fillet-soldered, thereby ensuring electrical and mechanical connections thereof to the predetermined conductive path n and enabling visibility of the state of connection thereof from the outside.

Since the extension electrode 20 extends from the output terminal pad 12*r* onto an end face of the dielectric porcelain block where the open end 8*a* is present, the connection between the output terminal pad 12*r* and the predetermined conductive path n can be checked from the outside. Further, since the extension electrode 20 is also connected to the predetermined conductive path n, the surface of joint is expanded, thereby enhancing retention strength. Additionally, the input terminal pad 12*t*, the antenna terminal 13, and the output terminal pad 12*r* are soldered at the bottom and side surfaces thereof via the connection conductors 16*b* and 16*a* and the extension electrode 20, respectively; i.e., each of the input terminal pad 12*t*, the antenna terminal 13, and the output terminal pad 12*r* is fillet-soldered. Therefore, the dielectric duplexer 1 as a whole can be enhanced in terms of electrical and mechanical connections, and the state of electrical and mechanical connections can be visually checked, thereby enhancing the reliability of the mounted state of the duplexer.

One of ordinary skill in the art will readily appreciate that the number of resonators to be employed may be varied as appropriate to implement a multiple-type dielectric duplexer.

The present dielectric duplexer is configured such that the output terminal pad is formed on a side surface of the dielectric porcelain block separated from the external conductor in such a manner as to face the vicinity of an open end of a resonator of the reception section, and an extension electrode is extended from the output terminal pad onto an end face of the dielectric porcelain block such that the extension electrode approaches the open end in order to capacitively couple with the resonator, thereby yielding the following effects:

The coupling capacitance can be readily corrected by adjusting the position of the end of the extension electrode. Further, this adjustment can be performed even after the dielectric duplexer is mounted.

When the dielectric duplexer is mounted, the extension electrode is exposed and is also joined to a predetermined conductive path by means of solder. Accordingly, the output terminal pad is soldered at the bottom and side surfaces thereof to thereby be fillet-soldered, thus enabling viewing of the electrical and mechanical connections thereof to the predetermined conductive path and, as a consequence, enhancing the reliability of the mounted state of the duplexer.

Finally, since the extension electrode allows fillet soldering, the mechanical joining strength can be enhanced, thereby enhancing the retention strength.

Although the invention has been described above in relation to preferred embodiments thereof, it will be understood by those skilled in the art that variations and modifications can be effected in these preferred embodiments without departing from the scope and spirit of the invention.

What is claimed:

1. An assembly comprising a printed circuit board having a conductor formed on a surface thereof; and a dielectric duplexer comprising:

a dielectric block having a plurality of resonators arranged in a row; each of said resonators being formed through coating an internal circumferential surface of a through-hole formed in said dielectric block with an internal conductor;

a predetermined external circumferential surface of said dielectric block being coated with an external conductor;

said resonators comprising a first group and a second group, said first group serving as a transmission section, and said transmission section being coupled with an input terminal pad formed on said predetermined external circumferential surface separated from said external conductor, said second group serving as a reception section, and said reception section being coupled with an output terminal pad formed on said predetermined external circumferential surface separated from said external conductor; and an antenna terminal pad formed on a mounting surface of said dielectric duplexer separated from said external conductor in such a manner as to be coupled with said transmission section and said reception section, a transmission excitation through-hole formed in said dielectric block at a position located to one side of said first group of resonators opposite to said second group of resonators, said input terminal pad being formed on a side surface of said dielectric block in the vicinity of, and in facing relation with, open end of the transmission excitation through-hole, and being connected to the transmission excitation through-hole via a connection conductor formed on an end face of said dielectric block at which said open end is located whereby said input terminal pad is coupled with said transmission section via said transmission excitation though-hole;

an antenna excitation through-hole formed in said dielectric block at a position between said first group of resonators and said second group of resonators, said antenna terminal pad being formed on a side surface of said dielectric block in the vicinity of, and in facing relation with, an open end of the antenna excitation through-hole, and being connected to the antenna excitation through-hole via a connection conductor formed on an end face of said dielectric block at which said open end is located, whereby said antenna terminal pad is coupled with both said reception section and said transmission section via the antenna excitation through-hole;

said output terminal pad being formed on a side surface of said dielectric block in the vicinity of and in facing relation with an open end of one of said resonators of said reception section, and said duplexer further comprising an extension electrode extending from said output terminal pad onto an end face of said dielectric block such that said extension electrode approaches the open end of said one resonator so as to capacitively couple with said one resonator of said reception section, said dielectric duplexer being mounted on said surface of said printed circuit board with said output terminal pad facing, said conductor, said end face and said extension electrode thereon being exposed, and a fillet or solder connection electrically connecting said output terminal pad to said conductor and also electrically connecting said extension electrode to said conductor.

2. The assembly according to claim 1, wherein said end face at which said open end of said transmission excitation through-hole is located is opposite the end face onto which said extension electrode is extended.

3. The assembly according to claim 1, wherein said input terminal pad is formed on the same side surface of said dielectric block as said output terminal pad.

4. The assembly according to claim 1, wherein said end face at which said open end of said antenna excitation through-hole is located is opposite the end face onto which said extension electrode is extended.

5. The assembly according to claim 1, wherein said antenna terminal pad is formed on the same side surface of said dielectric block as said output terminal pad.

6. The assembly according to claim 1, wherein said antenna terminal pad is coupled with respective resonators of said transmission and reception sections located closest to one another in said row.

7. The assembly according to claim 1, wherein a counterbore is formed in the dielectric block at an open end of each resonator of said transmission and reception sections.

8. The assembly according to claim 7, wherein said open ends of said resonators of said transmission and reception sections are all located at the same said end face of said dielectric block.

9. The assembly according to claim 1, wherein said dielectric block is made of porcelain.

10. An assembly comprising:

a printed circuit board including a conductor formed on a surface thereof; and a dielectric duplexer comprising:

a dielectric block having a plurality of resonators arranged in a row; each of said resonators being formed through coating an internal circumferential surface of a through-hole formed in said dielectric block with an internal conductor;

a predetermined external circumferential surface of said dielectric block being coated with an external conductor;

said resonators comprising a first group and a second group, said first group serving as a transmission section, and said transmission section being coupled with an input terminal pad formed on said predetermined external circumferential surface separated from said external conductor, said second group serving as a reception section, and said reception section being coupled with an output terminal pad formed on said predetermined external circumferential surface separated from said external conductor; and an antenna terminal pad formed on a mounting surface of said dielectric duplexer separated from said external conductor in such a manner as to be coupled with said transmission section and said reception section, said output terminal pad being formed on a side surface of said dielectric block in the vicinity of and in facing relation to an open end of one of said resonators of said reception section, and said duplexer further comprising an extension electrode extending from said output terminal pad onto an end face of said dielectric block such that said extension electrode approaches the open end of, and is capacitively coupled with said one resonator of said one reception section;

said dielectric duplexer being mounted on said surface of said printed circuit board with said output terminal pad facing, said conductor, and with said end face and said extension electrode thereon being exposed, and said duplexer further comprising a fillet solder connection electrically connecting said output terminal pad to said conductor and also electrically connecting said extension electrode to said conductor.

* * * * *